US009803825B2

(12) United States Patent
Windgruber

(10) Patent No.: US 9,803,825 B2
(45) Date of Patent: Oct. 31, 2017

(54) LIGHTING DEVICE FOR A VEHICLE HEADLIGHT

(71) Applicant: ZIZALA LICHTSYSTEME GMBH, Wieselburg (AT)

(72) Inventor: Patrick Windgruber, Gaming (AT)

(73) Assignee: ZKW GROUP GMBH, Wieselburg an der Erlauf (AT)

( * ) Notice: Subject to any disclaimer, the term of this patent is extended or adjusted under 35 U.S.C. 154(b) by 109 days.

(21) Appl. No.: 14/893,167

(22) PCT Filed: May 27, 2014

(86) PCT No.: PCT/AT2014/050126

§ 371 (c)(1),
(2) Date: Nov. 23, 2015

(87) PCT Pub. No.: WO2014/190368

PCT Pub. Date: Dec. 4, 2014

(65) Prior Publication Data

US 2016/0131324 A1 May 12, 2016

(30) Foreign Application Priority Data

May 29, 2013 (AT) ..... A50365/2013

(51) Int. Cl.
*F21S 8/10* (2006.01)

(52) U.S. Cl.
CPC ..... *F21S 48/328* (2013.01); *F21S 48/1109* (2013.01); *F21S 48/1159* (2013.01); *F21S 48/1305* (2013.01); *F21S 48/321* (2013.01)

(58) Field of Classification Search
CPC .. F21S 48/328; F21S 48/1109; F21S 48/1159; F21S 48/1305; F21S 48/321
(Continued)

(56) References Cited

U.S. PATENT DOCUMENTS 8,425,097 B2 * 4/2013 Yamamoto ..... F21S 48/1747 362/517
2003/0058656 A1 3/2003 Yamaguchi
(Continued)

FOREIGN PATENT DOCUMENTS

CN 1594965 A 3/2005
CN 101105286 A 1/2008
(Continued)

OTHER PUBLICATIONS

International Search Report and Written Opinion for PCT/AT2014/050126, dated Oct. 20, 2014.
(Continued)

*Primary Examiner* — Laura Tso
(74) *Attorney, Agent, or Firm* — Eversheds Sutherland (US) LLP

(57) ABSTRACT

The invention relates to a lighting device (1) for a vehicle headlight, wherein the lighting device comprises: at least one LED light source (2), at least one light-shaping optics body (3), which is paired with the at least one LED light source (2), and at least one LED light source carrier (4), on which the at least one LED light source (2) is fastened. In accordance with the invention, positioning means (3*a*, 3*b*, 3*c*) for positioning the at least one LED light source carrier (4) are provided on the optics body (3), positioning means (30; 3*a*) for the subsequent positioning of a heat sink (5) on the optics body (3) are also provided, wherein a fixing element (6) is also provided, which can be fastened to the optics body (3) in such a way that in the fastened state the fixing element (6) presses the heat sink (5) against the LED light source carrier (4), such that this is fixed in its position on the optics body (3).

22 Claims, 6 Drawing Sheets

Figure 1:
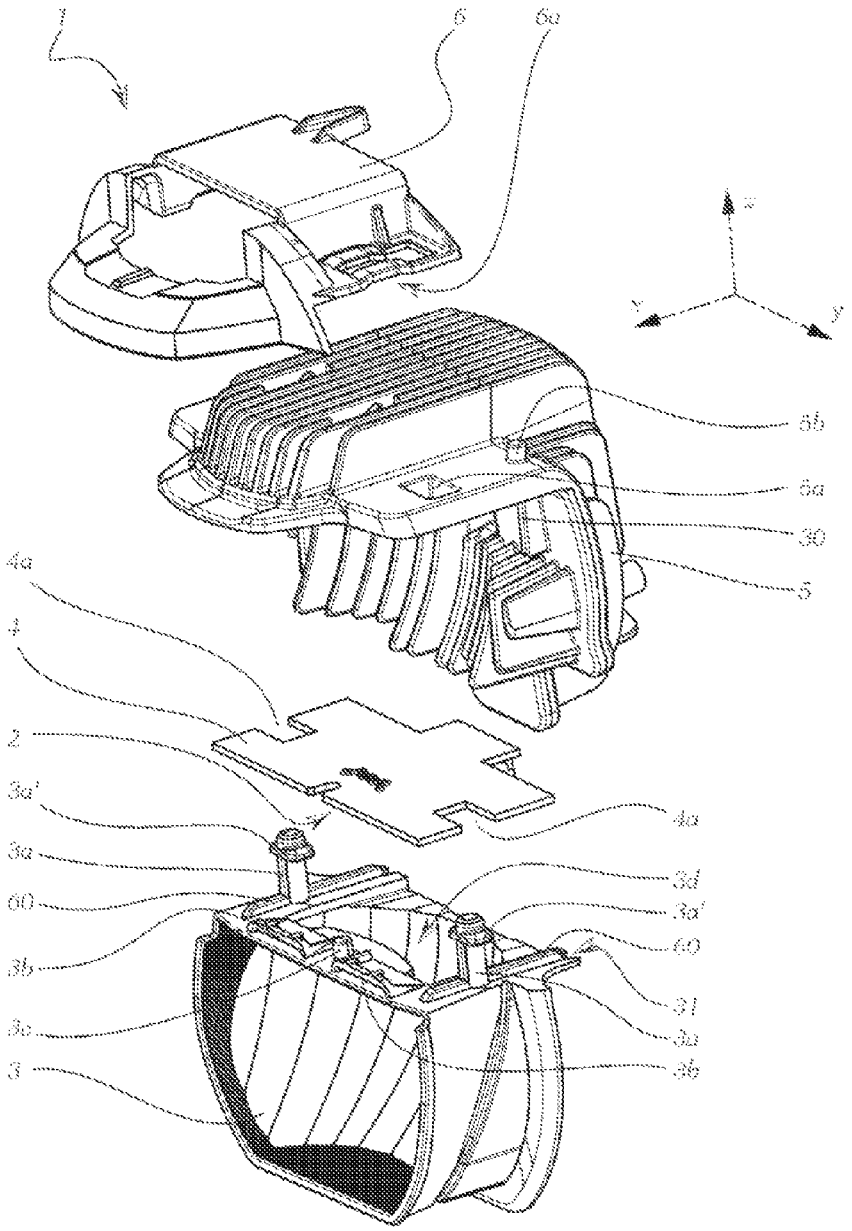

(58) Field of Classification Search
USPC ..... 362/294, 545, 547, 548, 549
See application file for complete search history.

(56) References Cited

U.S. PATENT DOCUMENTS

| | | | | |
|---|---|---|---|---|
| 2005/0052864 | A1* | 3/2005 | Colip | F21S 48/212 362/236 |
| 2007/0268703 | A1* | 11/2007 | Gasquet | F21K 9/00 362/294 |
| 2009/0168428 | A1* | 7/2009 | Huang | F21S 48/1159 362/294 |
| 2010/0020561 | A1* | 1/2010 | An | F21S 48/1154 362/516 |
| 2014/0226357 | A1* | 8/2014 | Brendle | F21S 48/1159 362/538 |

FOREIGN PATENT DOCUMENTS

| | | | |
|---|---|---|---|
| CN | 101639186 | A | 2/2010 |
| DE | 10224004 | A1 | 12/2002 |
| DE | 102010002664 | A1 | 9/2011 |
| DE | 10 2011 081 062 | A1 * | 2/2013 |
| DE | 102011081062 | A1 | 2/2013 |
| EP | 1519105 | A2 | 3/2005 |
| EP | 2116763 | A1 | 11/2009 |
| EP | 2484967 | A2 | 8/2012 |
| JP | 2007-318139 | A | 12/2007 |
| WO | 2013/024159 | A2 | 12/2013 |

OTHER PUBLICATIONS

English Translation of Office Action issued in Japanese Patent Application No. 2016-515572, dated Nov. 29, 2016.

English Translation of Search Report, State Intellectual Property Office of People's Republic China, issued in Chinese Patent Application No. 201480043082.6, dated Mar. 28, 2017.

* cited by examiner

LIGHTING DEVICE FOR A VEHICLE HEADLIGHT

The invention relates to a lighting device for a vehicle headlight, wherein the lighting device comprises:

at least one LED light source, at least one light-shaping optics body, which is paired with the at least one LED light source, and at least one LED light source carrier, on which the at least one LED light source is fastened.

The invention also relates to a vehicle headlight comprising at least one such lighting device.

In vehicle headlight construction, LED light sources consisting of one or more light-emitting diodes are increasingly used for the generation of one (or more) main light distribution(s), such as a full beam distribution, dipped light distributions, for example dipped beam, etc. Here, the light from one or more LED light sources is usually irradiated via one or more optics bodies, for example via one or more reflectors, add-on optics for example in the form of light-guiding bodies, etc., directly or via further optics bodies, into an area in front of the motor vehicle in which the vehicle headlight is installed, and lights up/light up the area in front of the vehicle.

In order to be able to provide a legally compliant light distribution, it is important that optics bodies and paired light source(s) are correctly positioned relative to one another. In particular with the use of LED light sources, this topic assumes even greater importance since here even relatively small deviations from the target position may lead to undesirable and/or impermissible effects in the light projection.

The LED light source(s) is or are usually arranged on a heat sink. The LED light source(s) sits or sit here on a carrier, which is usually in the form of an LED circuit board, and the carrier is in turn arranged on the heat sink, for example bonded thereto. The paired optics body is positioned suitably and is then fixed to the heat sink or in relation to the heat sink, generally screwed thereto or to another stationary component of the lighting device.

Here, however, it has often been found that the fastening process, in particular the tight screwing of the optics body and the forces occurring here, may cause the optics body to warp, or the fastening process generally may cause an unintentional displacement of the optics body from the optimal position. This has disadvantageous effects on the attained light projection, in part with the result that the light projection no longer meets the legal requirements.

In particular, the problem of the warping of the optics body occurs here when the optics body is formed as a reflector, which are often thin-walled and accordingly are susceptible to warpage.

The object is to create a lighting device for motor vehicle headlights with which the above-mentioned problems are overcome and an exact adjustment of the position of the least one LED light source in relation to the at least one optics body can be made.

This problem is achieved with a lighting device as mentioned in the introduction in that, in accordance with the invention positioning means for positioning the at least one LED light source carrier are provided on the optics body, positioning means for the subsequent positioning of a heat sink on the optics body are also provided, wherein a fixing element is also provided, which can be fastened to the optics body in such a way that in the fastened state the fixing element presses the heat sink against the LED light source carrier, such that this is fixed in its position on the optics body.

With the fixing element the heat sink according to the invention is fastened in a clamping manner to the optics body. The clamping force here presses the heat sink against the LED light source carrier and presses this against the optics body, such that the carrier is fixed permanently in its set position.

Due to the clamping fixing with the fixing element a screwing-on of the carrier and/or heat sink on the optics body can be avoided, and therefore the optics body, in particular a reflector, for example a free-form reflector, can preferably be connected to the LED light source(s).

The LED light source carrier is to be precisely fitted here accordingly with the LED light source(s) already before the assembly of the lighting device, and the optics body is also to be precisely manufactured accordingly. The lighting device presented in accordance with the invention, however, can thus also be manufactured without difficulty on an assembly line, since an adjustment of the optics body in relation to the LED light source(s) on the assembly line is no longer necessary and therefore the lighting device can be manufactured quickly and efficiently.

Is also advantageous that the heat sink is omitted from the tolerance chain in the case of the lighting device according to the invention.

In an advantageous embodiment of the invention at least two, preferably precisely two domes are arranged on the optics body, wherein it is advantageous in particular when the domes protrude from the optics body in a manner extending parallel to one another.

A "dome" is, for example, a pin-like component protruding from the optics body.

It is also advantageous when the domes are formed in one piece with the optics body, such that no undesirable forces are introduced into the optics body via the otherwise necessary fastening of the dome to said optics body.

In this preferred embodiment the optics body additionally also has at least one, preferably precisely two retaining springs, wherein the positioning means for the LED light source carrier comprises the least two, preferably precisely two domes and the at least one, preferably precisely two retaining springs.

Once the LED light source carrier has been placed onto the optics body—in the direction of the domes—the carrier is pressed by the retaining spring(s) in the direction of the domes and is thus temporarily positioned.

It is advantageous when the LED light source carrier has a number of recesses corresponding to the number of domes, by means of which recesses the LED light source carrier can be positioned in a direction normal to the orientation of the domes.

The recesses are arranged and formed here in such a way that the LED light source carrier having the recesses can be threaded into the domes and can then be moved in the direction of the optics body, where the carrier is lastly pressed into the retaining springs, such that these press the carrier having the recesses against the domes.

The position of the carrier on the optics body is in this way at least temporarily secured in the X direction, i.e. in the light exit direction.

Is also advantageous when a positioning pin is arranged on the optics body, preferably is formed in one piece with the optics body, and the LED light source carrier has a corresponding recess, by means of which the LED light source carrier can be positioned in a direction normal to the orientation of the domes.

The positioning pin is preferably arranged here between the two retaining springs, most expediently in the middle.

With this pin the carrier can be positioned in the Y direction, i.e. in the horizontal direction and normal to the X direction.

The heat sink is then arranged on the optics body with LED light source carrier positioned preliminarily thereon.

The positioning means for the heat sink preferably comprise at least one, preferably two positioning recesses and/or positioning ribs, which is/are arranged on the optics body, preferably is/are formed in one piece therewith.

The two positioning recesses and/or positioning ribs advantageously extend parallel to one another.

Is favourable here when the heat sink on a side facing towards the optics body has at least one, preferably precisely two positioning ribs and/or positioning recesses corresponding to the positioning recesses and/or positioning ribs.

The heat sink is inserted via its ribs into the positioning recesses, such that these recesses surround the ribs laterally and the position of the heat sink transversely to the longitudinal extension of the ribs is thus defined.

Alternatively or additionally, the positioning means for the heat sink may also be formed by the domes arranged on the optics body.

In any case, irrespectively of whether or not the domes serve as positioning means for the heat sink, the fixing means has a number of resilient clamp portions, preferably precisely two, corresponding to the number of domes.

The resilient clamp portions are formed here in particular or in any case so as to be resiliently deformable in the direction of the longitudinal extension of the domes, i.e. in the Z direction.

In addition, each dome in a region racing away from the optics body advantageously has at least one run-on portion for in each case one resilient clamp portion of the fixing element, wherein, when the fixing element is slid onto the optics body or the heat sink in a direction normal to the orientation of the domes, the resilient clamp portions are pressed in the direction of the optics body.

In this way the LED light source carrier and the heat sink are permanently fixed to the optics body by simply sliding the fixing element from the front onto the optics body with exposed heat sink.

It is expedient when the heat sink has a number of dome openings corresponding to the number of domes, through which openings the domes are inserted.

It is favourable in particular when, in the fully inserted state of the domes, the run-on portions lie at a distance above the respective dome opening.

Is also advantageous for the heat sink to have at least one, preferably precisely two stop pins, which at least one stop pin is preferably formed in one piece with the heat sink, wherein the at least one stop pin limits the sliding movement of the fixing element onto the heat sink.

Lastly, it is also favourable when the heat sink and the fixing element have retaining means, which prevents the fixing element from becoming detached from the heat sink in the slid-on state.

It can thus be ensured that a manual detachment of the fixing element from the heat sink is no longer possible and is potentially only still possible with a tool.

In accordance with a specific embodiment the retaining means have at least one, preferably chamfered pin and at least one corresponding indentation.

The indentation is preferably provided on the heat sink, and the pin is preferably provided on the fixing means; due to the chamfer, the pin can slide into the indentation, then hooks there, such that the fixing element can no longer be drawn downwards by the heat sink against the slide-on direction.

In accordance with a particularly advantageous embodiment the fixing means is formed as a design screen, which for example is formed from plastic or sheet metal.

On the one hand the fixing mean thus serves to fasten the heat sink and the LED light source carrier, and on the other hand regions of the lighting device which are not to be visually accessible can then also be screened by the fixing element.

The invention has proven to be particularly advantageous when the optics body is formed as a reflector.

In a specific embodiment of the invention the lighting device is formed as a light module for a vehicle headlight.

Here, the light module may be a reflection module or a projection module.

The object described in the introduction is additionally also achieved with a motor vehicle headlight that has at least one above-described lighting device.

Figure 2:
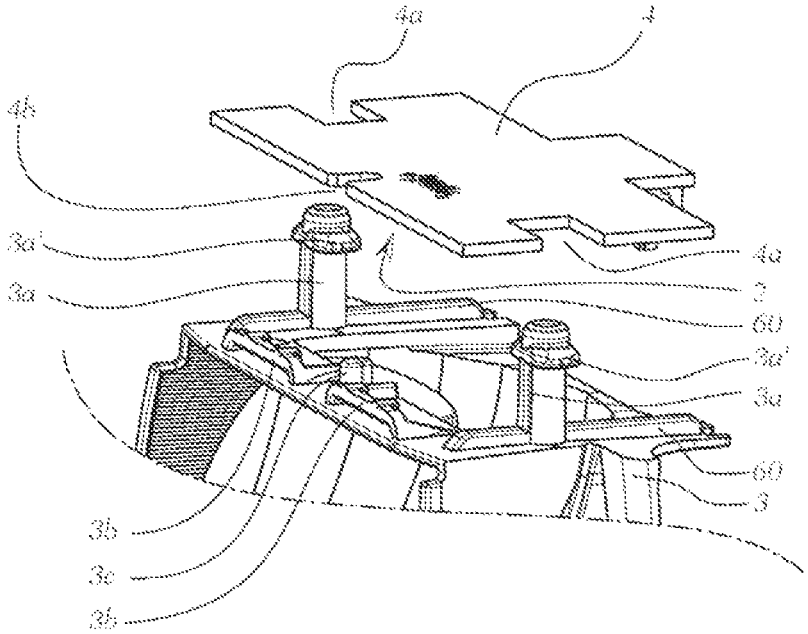
Figure 3:
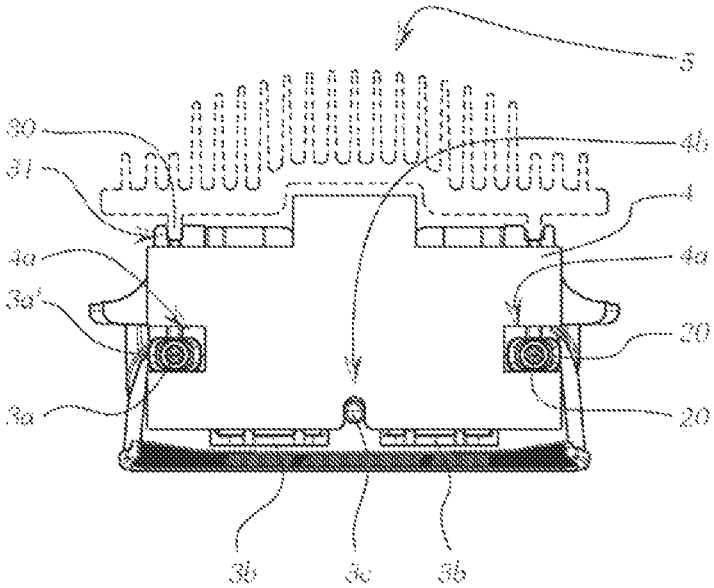
Figure 4:
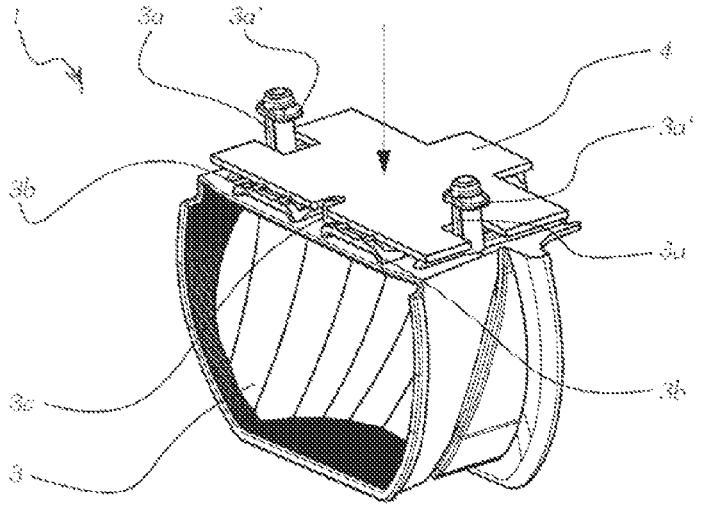
Figure 5:
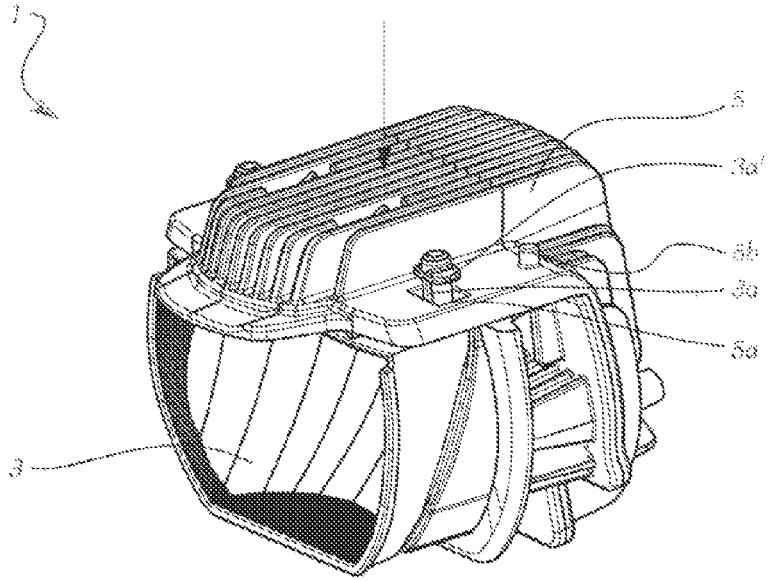
Figure 6:
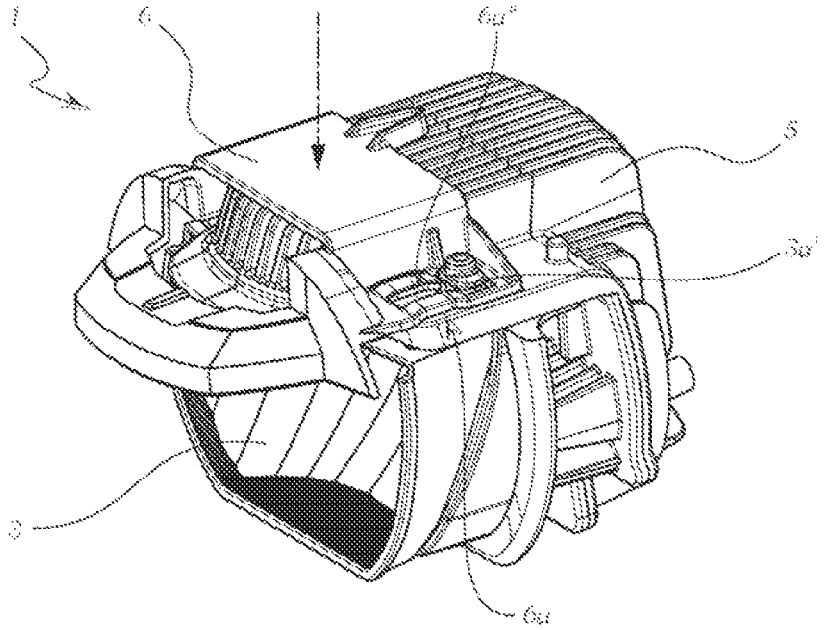
Figure 7:
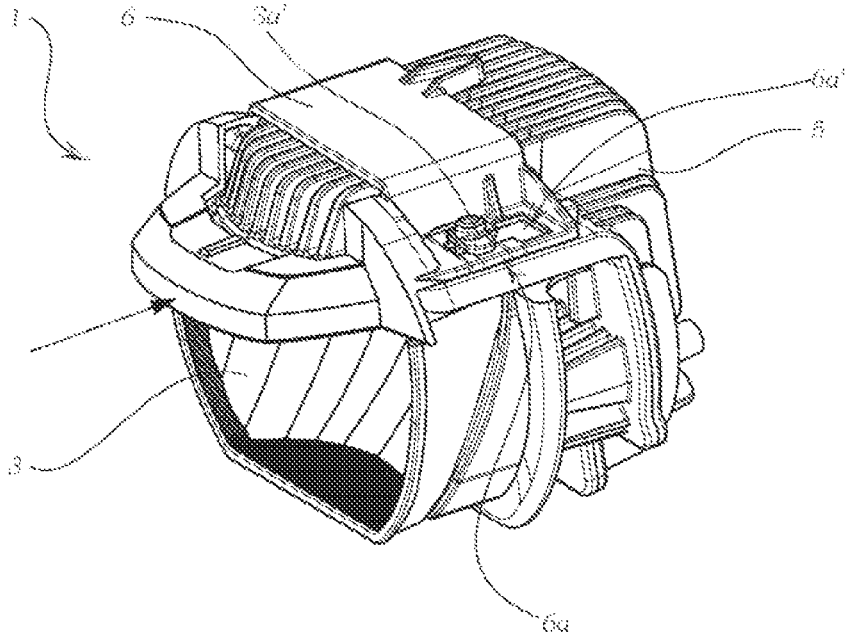
Figure 8:
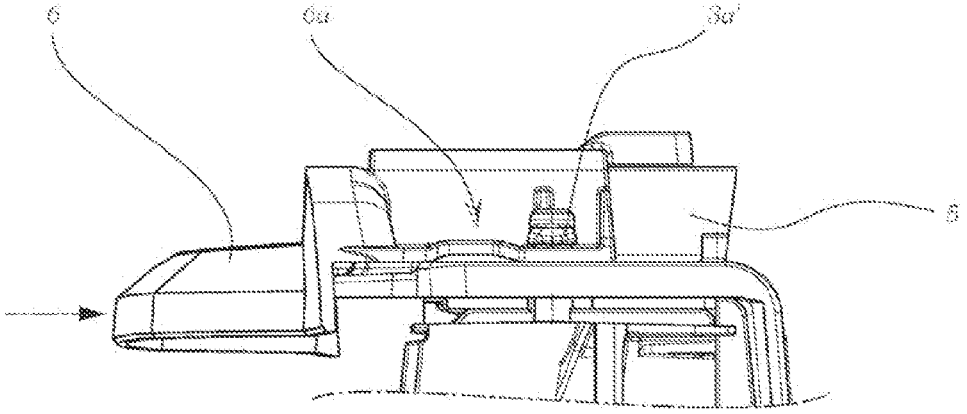
Figure 9:
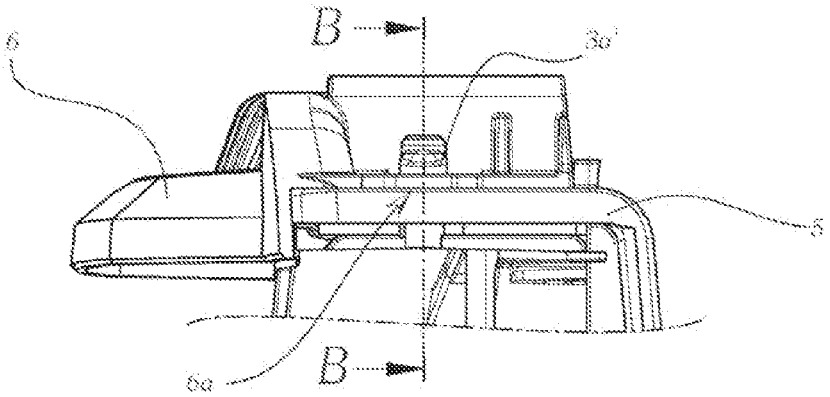
Figure 10:
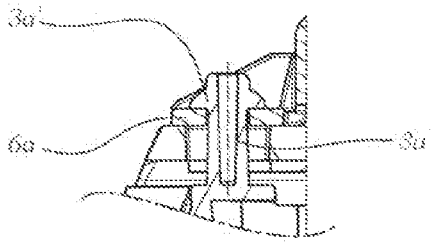
Figure 11:
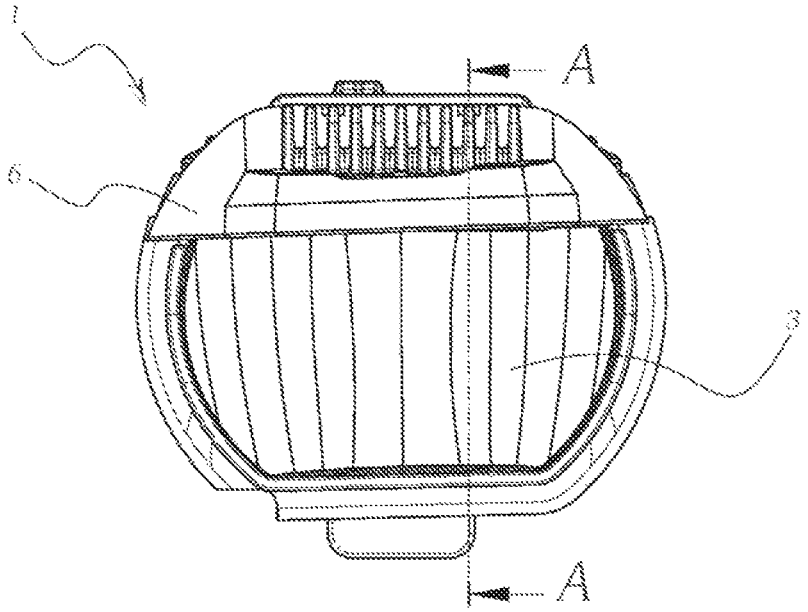
Figure 12:
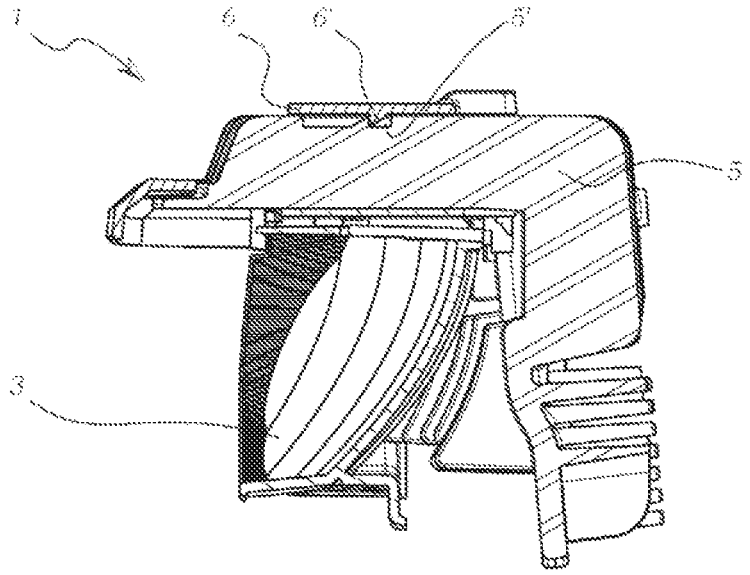

The invention is described in greater detail hereinafter on the basis of the drawing, in which FIG. 1 shows an exploded illustration of a lighting device according to the invention, FIG. 2 shows the optics body of the lighting device from FIG. 1 in a perspective view together with a light source carrier prior to the positioning, FIG. 3 shows a view of the optics body together with a schematic illustration of a heat sink from above with placed-on light source carrier, FIG. 4 shows a perspective view of the optics body with placed-on a light source carrier, FIG. 5 shows the arrangement from FIG. 4 with additionally placed-on heat sink in a perspective view, FIG. 6 shows the arrangement from FIG. 5, additionally with the fixing means in placed, but not yet slid-on position in a perspective view, FIG. 7 shows the arrangement from FIG. 5, additionally with the fixing means in placed position, now already slid on, in a perspective view, FIG. 8 shows the situation from FIG. 6 in a side view in the region of the fixing means, FIG. 9 shows the situation from FIG. 7 in a side view in the region of the fixing means, FIG. 10 shows a vertical section along the line B-B from FIG. 9, FIG. 11 shows a lighting device from FIG. 1 in the assembled state in a view from the front, and FIG. 12 shows a section along the line A-A from FIG. 11.

FIG. 1 shows the components relevant to the invention of a lighting device 1 for a vehicle headlight. The lighting device 1 here other comprises, in the shown embodiment, an LED light source 2, which in the shown embodiment consists of a plurality of LEDs (light-emitting diodes). The lighting device 1 also comprises a light-shaping optics body 3, which is paired with the LED light source 2. The LED light source 2 couples light into the optics body 3 via a coupling-in point 3*d*.

In the specific example the optics body 3 is a reflector 3, and the coupling-in point 3*d* is formed as an opening in the reflector, via which the LED light source 2 can emit its light onto the reflective surface of the reflector.

Generally, i.e. independently of the type of optics body, one or more LED light sources may be provided, wherein each LED light source may have one or more LEDs. Some or all of the LED light sources preferably can be controlled, i.e. can be switched on/off and where necessary also dimmed, independently of one another. It may also be advantageous when individual LEDs or each LED of an LED light source can be controlled independently.

The lighting device also comprises an LED light source carrier 4, on which the LED light source 2 is fastened. The carrier 4 is generally an LED circuit board.

Lastly, the lighting device 1 also comprises a heat sink 5 for dissipating the heat generated by the LED light source 2, and a fixing means 6, of which the function will be described in greater detail hereinafter.

When the lighting device 1 is assembled, the LED circuit board 4 is positioned and temporarily fixed on the optics body 3 for the time being, and the heat sink 5 is then positioned on the optics body 3 and the LED circuit board 4 and is fixed using the fixing means 6.

In the shown embodiment the optics body 3 here has two preferably parallel webs or ribs 60, on which the carrier 4 rests.

For this purpose positioning means 3*a*, 3*b*, 3*c* for positioning the LED light source carrier 4 are provided for the time being on the optics body 3.

The positioning means on the optics body 3 here comprise two domes 3*a*, which are formed in one piece with the optics body 3 and protrude therefrom in a manner extending parallel to one another. Here, the domes 3*a* are—generally, i.e. independently of the specific embodiment of the optics body—preferably arranged in the region of the "coupling-in point", i.e. in the specific example in the region of the opening 3*d* of the reflector 3. It is optimal when the domes 3*a* are arranged here symmetrically around the coupling-in point.

The positioning means also comprise two retaining springs 3*b*, which in turn are preferably formed in one piece with the optics body 3.

FIGS. 2 and 3 show the carrier 4 before the placement, this being placed onto the optics body 3 along the domes 3*a* in the direction of said optics body. FIG. 4 shows the carrier 4 in the state already placed and positioned on the optics body 3. Here, the carrier 4, once the LED light source carrier 4 has been placed onto the optics body 3, is pressed by the retaining springs 3*b* in the direction of the domes 3*a* and is thus temporarily positioned.

In order to be able to place the carrier 4 on the optics body 3, the LED light source carrier 4 has two—preferably open on one side—recesses 4*a*, which surround the associated domes 3*a*—in the shown example on three sides. The LED light source carrier 4 can be positioned in the X direction, normal to the orientation Z of the domes 3*a*, via the recesses 4*a*.

The recesses 4*a* are thus arranged and formed in principle in such a way that the LED light source carrier 4 can be threaded via the recesses 4*a* into the domes 3*a* and then can be moved in the direction of the optics body 3, where the carrier 4 is lastly pressed into the retaining springs 3*b*, such that these press the carrier having the recesses 4*a* against the domes 3*a* (see FIG. 3, for example).

The carrier 4 is in this way at least temporarily positioned and held in its position on the optics body in the X direction (see FIG. 1 with regard to the coordinates), i.e. in the light exit direction.

The positioning means additionally also comprise a positioning pin 3*c*, which is arranged on the optics body 3, is preferably formed in one piece with the optics body 3, and the LED light source carrier 4 has a corresponding recess 4*b*, by means of which the LED light source carrier 4 can be positioned on the optics body 3 in the Y direction.

Here, "can be positioned" means that the position of the carrier, etc. in the respective direction (X, Y, etc.) is determined with the respective component (dome, pin, retaining spring).

Here, the positioning pin 3*c* is preferably arranged between the two retaining springs 3*b*, most expediently in the middle between the positioning pins 3*c*.

With this pin the carrier 4 can thus be positioned in the Y direction, i.e. in the horizontal direction and normal to the X direction.

In a next step the heat sink 5 is positioned on the optics body 3, for which purpose positioning means 31 for the heat sink 5 are provided on the optics body 3.

The positioning means for the heat sink 5 are formed in the shown embodiment as two positioning recesses 31 (see FIGS. 1 and 2 for example), which positioning recesses 31 are arranged on the optics body 3, preferably formed in one piece therewith. The two positioning recesses 31 advantageously extended parallel to one another.

The heat sink 5 has, on a side facing towards the optics body 5, two positioning ribs 30 corresponding to the positioning recesses 31, for example see FIG. 1.

The heat sink is inserted via its positioning ribs 30 into the positioning recesses 31, such that these surround the ribs 30 laterally and the position of the heat sink transversely to the longitudinal extension of the ribs is thus defined.

In addition, the heat sink 5 has two dome openings 5*a*, through which the domes 3*a* are inserted when the heat sink 5 is applied. Here, the domes 3*a* have two run-on portions 3*a*', of which the function will be explained in greater detail further below, and the dome openings 5*a* are made sufficiently large that the domes 3*a* inclusive of the run-on portions 3*a*' thereof can be inserted therethrough. The run-on portions 3*a*' are formed here preferably in one piece with their respective dome 3*a*.

It is favourable in particular when, in the fully inserted-through state of the domes 3*a*, the run-on portions 3*a*' are arranged at a distance above the respective dome opening 5*a*.

In order to fix the heat sink 5 and thus the LED light source carrier 4 on the optics body 3, a fixing element 6 is also provided. This fixing element 6 can be fastened to the optics body 3 in such a way that in the fastened state the fixing element 6 presses the heat sink 5 against the LED light source carrier 4, such that this is fixed in its position on the optics body 3.

Here, the fixing element 6 holds the heat sink 5 in a clamped manner on the optics body 3. For this purpose the fixing element 6 has one or more retaining areas, which exert a clamping force when the fixing element 6 is applied to, in particular slid onto, the optics body 3 and heat sink 5. This clamping force here presses the heat sink 5 against the LED light source carrier 4 and presses this against the optics body 3, such that the carrier 4 is permanently fixed in its set, temporary position described above.

Due to the clamping fixing with the fixing element 6, a screwing-on of the carrier and/or heat sink on the optics body can be avoided, such that the optics body, in particular a reflector, for example a free-form reflector, can preferably be connected to the LED light source(s).

Here, the LED light source carrier 4 is to be precisely fitted here accordingly with the LED light source(s) 2 already before the assembly of the lighting device 1, and the optics body 3 is also to be precisely manufactured accordingly. The lighting device presented in accordance with the invention, however, can thus also be manufactured without difficulty on an assembly line, since an adjustment of the optics body in relation to the LED light source(s) on the assembly line is no longer necessary and therefore the lighting device can be manufactured quickly and efficiently.

Is also advantageous that the heat sink is omitted from the tolerance chain in the case of the lighting device according to the invention.

The above-mentioned retaining areas of the fixing element 6—one, two or more retaining areas in this case, the number corresponding preferably to the number of the domes 3*a*—are formed in the shown embodiment as (corresponding to the number of 2 domes) precisely two resilient clamp portions 6*a*, each clamp portion 6*a* constituting a retaining area.

The resilient clamp portions 6*a* are formed here in particular or in any case so as to be resiliently deformable in the direction of the longitudinal extension of the domes, i.e. in the Z direction.

As already mentioned above, each dome 3*a* in a region racing away from the optics body 3 has a run-on portion 3*a*' for in each case one resilient clamp portion 6*a* of the fixing element 6.

FIGS. 6 and 8 show the fixing element 6 in a state placed onto the heat sink 5, but not yet slid on. As can be seen in FIG. 7, the fixing element 6 has openings 6*a*' for pushing through the domes 3 inclusive of run-on faces 3*a*. The clamp portions 6*a* are slotted, such that the fixing element can be slid onto the heat sink 5, wherein the domes 3*a* are slid into the corresponding slots 6*a*" (FIG. 6).

When the fixing element 6 is slid (FIGS. 7 and 9) onto the optics body 3 or the heat sink 5 in a direction normal to the orientation Z of the domes 3*a*—specifically in the negative X direction—the resilient clamp portions 6*a* are pressed in the direction of the optics body 3.

In this way the LED light source carrier 4 and the heat sink are permanently fixed to the optics body by simply sliding the fixing element 6 from the front onto the optics body 3 with exposed heat sink 5.

When the fixing element 6 is slid on, preferably from the front as illustrated, against the light exit direction, the resilient portions 6*a* of the fixing element 6 come beneath the run-on portions 3*a*, as can be clearly seen in FIGS. 7 and 9, i.e. between the run-on portion 3*a* and heat sink, wherein the resilient portions 6*a* are pressed by the run-on portions 3*a*' against the heat sink 5.

Due to the restoring force of the resilient portions 6*a*, the components constituted by the optics body 3 (via the domes 3*a*), heat sink 5 and LED light source carrier 4 are thus pressed against one another and thus fixed, without having to mount screws in the optics body 3.

FIG. 10 shows once again the situation in the region of a resilient portion 6*a* once the fixing element 6 has been slid onto the heat sink 5.

The heat sink 5 additionally has two stop pins 5*b*, which are preferably formed in one piece with the heat sink 5*b*, wherein the stop pins 5*b* delimit the sliding movement of the fixing element 6 onto the heat sink 5.

A continued sliding the fixing element 6 is prevented by the stop pin 5*b*, the stop pin 5*b* thus forms a stop for the fixing element 6 so that this remains in a defined X position relative to the other components.

Reference is also made hereinafter to FIGS. 11 and 12, wherein, in particular in FIG. 12, which shows a section along the line A-A through the lighting device 1, it can be seen that the heat sink 5 and the fixing element 6 have retaining means 5', 6', which prevents the fixing element 6 from detaching from the heat sink 5 in the slid-on state.

It can thus be ensured that a manual detachment of the fixing element 6 from the heat sink 5 is no longer possible and is potentially only still possible with a tool.

In the specific embodiment from the figures the retaining means have at least one, preferably chamfered pin 6' and at least one corresponding indentation 5'.

The indentation 5' is preferably provided on the heat sink 5, and the pin 6' is preferably provided on the fixing means; due to the chamfer, the pin 6' can slide into the indentation 5', then hooks there, such that the fixing element can no longer be drawn downwards by the heat sink against the slide-on direction.

In accordance with a particularly advantageous embodiment as illustrated in the figures, the fixing means 6 is formed as a design screen, which for example is formed from plastic or sheet metal.

On the one hand the fixing mean thus serves to fasten the heat sink and the LED light source carrier, and on the other hand regions of the lighting device which are not to be visually accessible can then also be screened by the fixing element.

By way of example, the heat sink 5 can be covered by the design screen 6, such that the heat sink is not visible from the outside in the installed state of the lighting device.

With the present invention is thus possible to fasten an LED light source carrier to an optics body, in particular a reflector, for example a free-form reflector, without screws, such that no torque acts on the optics body. Merely a tensile force is applied in the region of the domes, i.e. a tensile force is introduced into the optics body merely via the domes.

The invention claimed is:

1. A lighting device (1) for a vehicle headlight, wherein the lighting device comprises:

at least one LED light source (2);

at least one light-shaping optics body (3), which is paired with the at least one LED light source (2); and at least one LED light source carrier (4), on which the at least one LED light source (2) is fastened;

positioning means (3*a*, 3*b*, 3*c*) on the optics body (3) for positioning the at least one LED light source carrier (4);

positioning means (31; 3*a*) for the subsequent positioning of a heat sink (5) on the optics body (3); and a fixing element (6), which can be fastened to the optics body (3) in such a way that in a fastened state the fixing element (6) presses the heat sink (5) against the LED light source carrier (4), such that this is fixed in its position on the optics body (3), wherein at least two domes (3*a*) are arranged on the optics body (3), wherein the fixing element (6) has a number of resilient clamp portions (6*a*) corresponding to the number of the at least two domes (3*a*), wherein each dome (3*a*) in a region extending away from the optics body (3) has at least one run-on portion (3*a*') for in each case one resilient clamp portion (6*a*) of the fixing element (6), and wherein the fixing element (6) is configured to be slid onto the optics body (3) or the heat sink (5) in a direction normal to the orientation (Z) of the domes (3*a*), and the resilient clamp portions (6*a*) are configured to be pressed and clamped against the at least one run-on portion (3*a*') in the direction of the optics body (3).

2. The lighting device of claim 1, wherein the at least two domes (3*a*) protrude from the optics body (3) in a manner extending parallel to one another.

3. The lighting device of claim 1, wherein the at least two domes (3*a*) are formed in one piece with the optics body (3).

4. The lighting device of claim 1, wherein the optics body (3)-comprises at least one retaining spring (3*b*), wherein the positioning means for the LED light source carrier (4) comprises the least two domes (3*a*) and the at least one retaining spring (3*b*).

5. The lighting device of claim 1, wherein the LED light source carrier (4) has a number of recesses (4*a*) corresponding to the number of domes (3*a*), by means of which recesses the LED light source carrier (4) can be positioned in a direction (X) normal to the orientation (Z) of the domes (3*a*).

6. The lighting device of claim 1, further comprising a positioning pin (3*c*) arranged on the optics body (3), wherein the LED light source carrier (4) has a corresponding recess (4*b*), by means of which the LED light source carrier (4) can be positioned in a direction (Y) normal to the orientation of the at least two domes (3*a*).

7. The lighting device of claim 1, wherein the positioning means for the heat sink (5) comprise at least one positioning recess (31) and/or positioning rib, which is/are arranged on the optics body (3).

8. The lighting device of claim 7, which comprises at least two positioning recesses and/or positioning ribs arranged on the optics body, and the at least two positioning recesses (31) and/or positioning ribs extend parallel to one another.

9. The lighting device of claim 7, wherein the heat sink (5) on a side facing towards the optics body (5) has at least one positioning rib (30) corresponding to the at least one positioning recess (31) arranged on the optics body.

10. The lighting device of claim 1, wherein the positioning means for the heat sink (5) are formed by the at least two domes (3*a*) arranged on the optics body (3).

11. The lighting device of claim 1, wherein the heat sink (5) has a number of dome openings (5*a*) corresponding to the number of the at least two domes (3*a*), through which openings the at least two domes (3*a*) are inserted.

12. The lighting device of claim 1, wherein in the fully inserted state of the at least two domes (3*a*), the run-on portions (3*a*') lie at a distance above the respective dome opening (5*a*).

13. The lighting device of claim 1, wherein the heat sink (5) has at least one stop pin (5*b*), wherein the at least one stop pin (5*b*) limits the sliding movement of the fixing element (6) onto the heat sink (5).

14. The lighting device of claim 1, wherein the heat sink (5) and the fixing element (6) have retaining means (5', 6'), which prevents the fixing element (6) from becoming detached from the heat sink (5) in the slid-on state.

15. The lighting device of claim 14, wherein the retaining means comprises at least one chamfered pin (6') and at least one corresponding indentation (5').

16. The lighting device of claim 1, wherein the fixing means (6) is formed as a design screen.

17. The lighting device of claim 1, wherein the optics body (3) is formed as a reflector.

18. The lighting device of claim 1, which is formed as a light module for a vehicle headlight.

19. The lighting device of claim 18, wherein the light module is a reflection module.

20. A motor vehicle headlight having at least one lighting device according to claim 1.

21. The lighting device of claim 4, wherein the positioning means for the LED light source has precisely two of the at least two domes and the optics body has precisely two of the at least one retaining spring.

22. The lighting device of claim 7, wherein the heat sink (5) on a side facing towards the optics body (5) has at least one positioning recess corresponding to the at least one positioning rib arranged on the optics body.

* * * * *